US008119055B2

(12) United States Patent
Pellengo Gatti

(10) Patent No.: US 8,119,055 B2
(45) Date of Patent: Feb. 21, 2012

(54) METHOD AND APPARATUS FOR CORRUGATING AND WINDING UP ROLLS OF PLASTIC FILM

(75) Inventor: Roberto Pellengo Gatti, Novara (IT)

(73) Assignee: NO. EL. S.R.L., Novara (IT)

( * ) Notice: Subject to any disclaimer, the term of this patent is extended or adjusted under 35 U.S.C. 154(b) by 214 days.

(21) Appl. No.: 12/131,948

(22) Filed: Jun. 3, 2008

(65) Prior Publication Data

US 2008/0296810 A1 Dec. 4, 2008

(30) Foreign Application Priority Data

Jun. 4, 2007 (IT) ..... MI2007A1133

(51) Int. Cl.
*B29C 59/06* (2006.01)

(52) U.S. Cl. ..... 264/505; 264/555; 264/571; 242/417; 242/417.1; 242/419.3

(58) Field of Classification Search ..... 264/505, 264/555, 571; 242/417, 417.1, 419.3
See application file for complete search history.

(56) References Cited

U.S. PATENT DOCUMENTS

| | | | | |
|---|---|---|---|---|
| 2,902,718 | A * | 9/1959 | Martelli et al. | 425/303 |
| 5,241,907 | A * | 9/1993 | Dorsam et al. | 101/409 |
| 5,611,272 | A * | 3/1997 | Steuer | 101/23 |
| 7,611,087 | B2 * | 11/2009 | Gatti | 242/412.2 |

FOREIGN PATENT DOCUMENTS

| | | | |
|---|---|---|---|
| DE | 1 093 547 | B | 11/1960 |
| EP | 0 646 451 | B1 | 9/1998 |
| EP | 0 728 102 | B1 | 2/1999 |
| WO | 2005/123555 | A1 | 12/2005 |

OTHER PUBLICATIONS

European Search Report dated Aug. 18, 2009.

* cited by examiner

*Primary Examiner* — Richard Crispino
*Assistant Examiner* — Elizabeth Royston
(74) *Attorney, Agent, or Firm* — Lucas & Mercanti, LLP

(57) ABSTRACT

A method and an apparatus for corrugating and winding up rolls of a plastic film. The plastic film is corrugated as it is continuously wound onto a roll, by a film drawing drum conformed with a plurality of longitudinally extending grooves to perform open-end corrugation or folds which extend crosswise the film; the plastic film is corrugated cross-wise, causing the same film to penetrate into the grooves of the drawing drum by suction of air through a plurality of suction holes which open out into the grooves of the drum.

7 Claims, 4 Drawing Sheets

METHOD AND APPARATUS FOR CORRUGATING AND WINDING UP ROLLS OF PLASTIC FILM

BACKGROUND OF THE INVENTION

This invention refers to the formation of rolls in film plastic material, in particular to a method and an apparatus for corrugating and winding up rolls of a plastic film which is provided with a plurality of crosswise corrugations or pleats, extending between opposite open-end side edges, as the plastic film is wound up into a roll.

Although the invention finds its application in the production of rolls of plastic films for packing and/or wrapping loads, the aforementioned method and apparatus prove to be particularly suitable for winding up coreless rolls, or rolls with a soft core made of thin cardboard, for example 1 or 2 mm thick, by an extensible stretchable plastic film.

STATES OF THE ART

It is well known that stretchable plastic films are widely used for packing and wrapping palletized loads, in order to give the load the necessary protection and stability.

Usually a plastic film can be produced by linear or circular extrusion heads, and subsequently wound up into rolls having weight and size suitable for the manual wrapping of a load, or by an automatic wrapping machine.

The plastic film can be wound up into rolls either around a rigid tubular core, generally of cardboard or plastic material, having a wall thickness of 3 or 4 mm, or made of thin cardboard, or directly wound around itself thereby forming a so-called "coreless" roll.

In the production of rolls of a stretchable plastic film, several problems arise caused by the natural adhesiveness of the plastic material, and by the elastic memory of the same plastic film after has been stretched; these problems can lead to the production of faulty rolls, or to the implosion of the rolls themselves if wound up without any internal supporting core, or with a core of a thin cardboard.

In order to partially solve these problems, EP 0.728.102 suggests the use of a textured roller provided with a peripheral teething for partially deforming the plastic film, embossing a plurality of small pockets suitable to trap air in the rolled film, during the winding; the trapped air will tend to prevent adhesion between the turns of the roll, and facilitates the subsequent unwinding of the film. This solution however does not prevent any possible deformation and implosion of the rolls both at the winding and over time, caused by the shrinkage due to the elastic memory of the film.

In turn, WO 05/123555 suggests the use of a grooved drawing drum having a peripheral surface provided with a plurality of longitudinally extending grooves to shape or fold the plastic film with a plurality of crosswise pleats, or open-end corrugations, which extend crosswise between the opposite side edges of the film; the plastic film is urged and folded into longitudinal grooves of the drawing roller, by air jets as it is continuously made to move towards a roll being wound.

Although this solution has allowed a substantial improvement and the formation of rolls of regular diameter and shape, in which any incidental yielding or implosion of the turns is substantially compensated by a controlled flattening of the crosswise pleats, made possible by venting air from the open ends of the pleats, further improvements are however possible in the method of corrugating or folding the crosswise pleats, as well as in the apparatus.

In the case of extensible or stretchable films, a different behaviour was in fact noted, both during the winding up of the rolls and subsequently, depending upon whether the plastic film is extruded in a flat or tubular form, due to the different molecular orientation resulting from the different stretching conditions, and from the different elastic memory of the plastic films.

While on the one hand, the use of air jets to fold and cause the plastic film to penetrate into the longitudinal grooves of a drawing and corrugating drum, as proposed in WO 05/123555, has enabled the production of wholly regular rolls, reducing any risk of implosion, from tests and experiments subsequently carried out it was found that in certain cases, or with certain types of plastic film, it does not allow an adequate control of the corrugations, in the forming of the pleats, and in the winding up of the film. On the contrary, the tests carried out proved that this control of the corrugations is necessary in order to compensate a different shrinkage degree of the plastic material both during the winding up of the roll, and over time, due to the different elastic memory of the same films; it was also noted that the action of the air jets some times is opposed by the cushioning of air that remains trapped between the film and the grooved drum, especially at high winding revolutions, which causes a certain lateral instability in the positioning of the film both on the grooved drum and on the roll being wound.

OBJECTS OF THE INVENTION

The main object of this invention is therefore to provide a method and an apparatus for corrugating and winding up plastic film into rolls, capable of obviating the drawbacks of the previously known methods and devices, by means of which it is possible to wind up rolls with or without an internal supporting core, in a controlled manner and of a wholly regular shape.

A still further object of the invention is to provide a method and an apparatus of the aforementioned kind, by means of which it is possible to control the effect and the corrugation depth of the plastic film, depending upon the characteristics of the same film to be wound, and of the rolls.

A still further object is to provide a method and an apparatus for corrugating and winding up plastic films into rolls, by which it is possible to further reduce any deformation risk of the rolls caused by an implosion of its turns, or by an uncontrolled shrinkage of the film itself, over the time.

The invention is particularly applicable for producing rolls of stretchable plastic films wound either around a rigid or soft tubular core, or for producing coreless rolls.

BRIEF DESCRIPTION OF THE INVENTION

According to a main feature of the invention, use is made of a grooved drawing drum for corrugating a plastic film material to be wound onto a roll, said grooved drum with a plurality of longitudinally extending grooves and air suction holes opening into the corrugating grooves and means to connect the air suction holes to an air suction source and to allow a controlled penetration and folding of the plastic film into the grooves of the drawing drum during the winding up of the film onto the roll.

BRIEF DESCRIPTION OF THE DRAWINGS

These and further characteristics of a method, a corrugating drum, and an apparatus for winding up rolls of plastic films, as well as a preferential embodiment, will be more clearly evident from the following description, with reference to the drawings, in which.

DETAILED DESCRIPTION OF THE INVENTION

Figure 1:
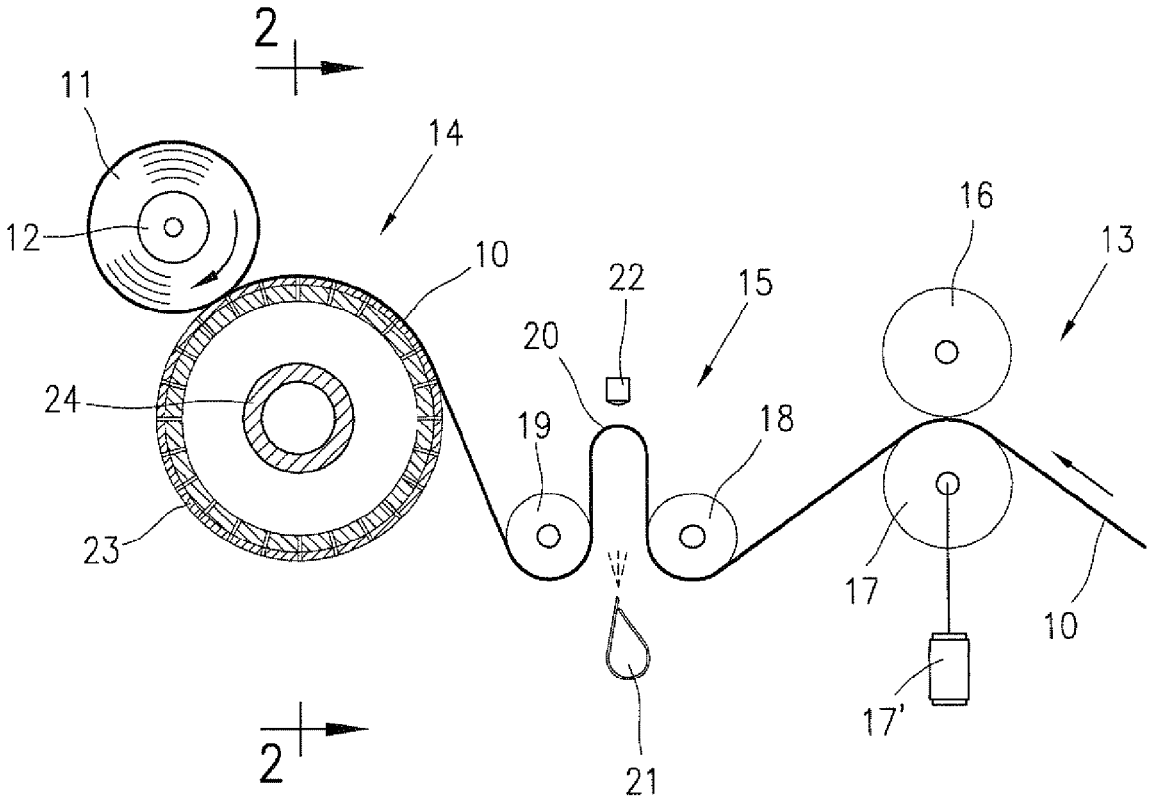
FIG. 1 shows a schematic representation of an apparatus according to the invention.

With reference to FIG. 1, a description will now be given of the essential parts of an apparatus for winding up rolls of plastic films, comprising the improvements according to the invention.

In FIG. 1, the reference number 10 indicates a plastic film for example fed from a large pre-wound roll, or directly from an extrusion head (not shown), to form a roll 11 of limited dimensions, by winding up the film 10 around a tubular core, or directly onto a mandrel 12, in the form of a coreless roll.

The film 10, preferably in a pre-stretched state, is made to move between a first drawing assembly 13 and a second drawing assembly 14, between which a tension control device 15 is disposed for controlling the tensioning of the film, before to be wound.

In particular, the first drawing assembly 13 comprises a pair of drawing rollers 16, 17 one of which is operatively connected to a driving motor 17'; the control device 15 suitable for balancing the tensioning of the film 10 in turn comprises a pair of spaced apart and parallely arranged idle rollers 18, 19, between which an upwardly oriented loop 20 of the film 10 is formed and supported, in a freely floating condition, by an air jet generated by a nozzle 21; reference number 22 in FIG. 1 has been used to indicate a film sensing device for controlling the position and depth of the loop 20 of the film.

The second drawing assembly 14 in turn comprises a grooved and perforated drawing drum 23 rotatably and pivotally supported to be urged against the roll 11; the drawing drum 23 in turn is connected to a respective driving motor, not shown, to cause the plastic film 10 to move towards the roll 11 drawing the same roll 11 into rotation.

As more clearly shown in the remaining figures, the drawing drum 23 is conformed with a plurality of longitudinally extending outer grooves 31 open frontally and at both ends, into which the plastic film 10 is made to penetrate to form a plurality of pleats or cross corrugations, open at both ends, which extend between the two opposite side edges of the film 10.

Figure 2:
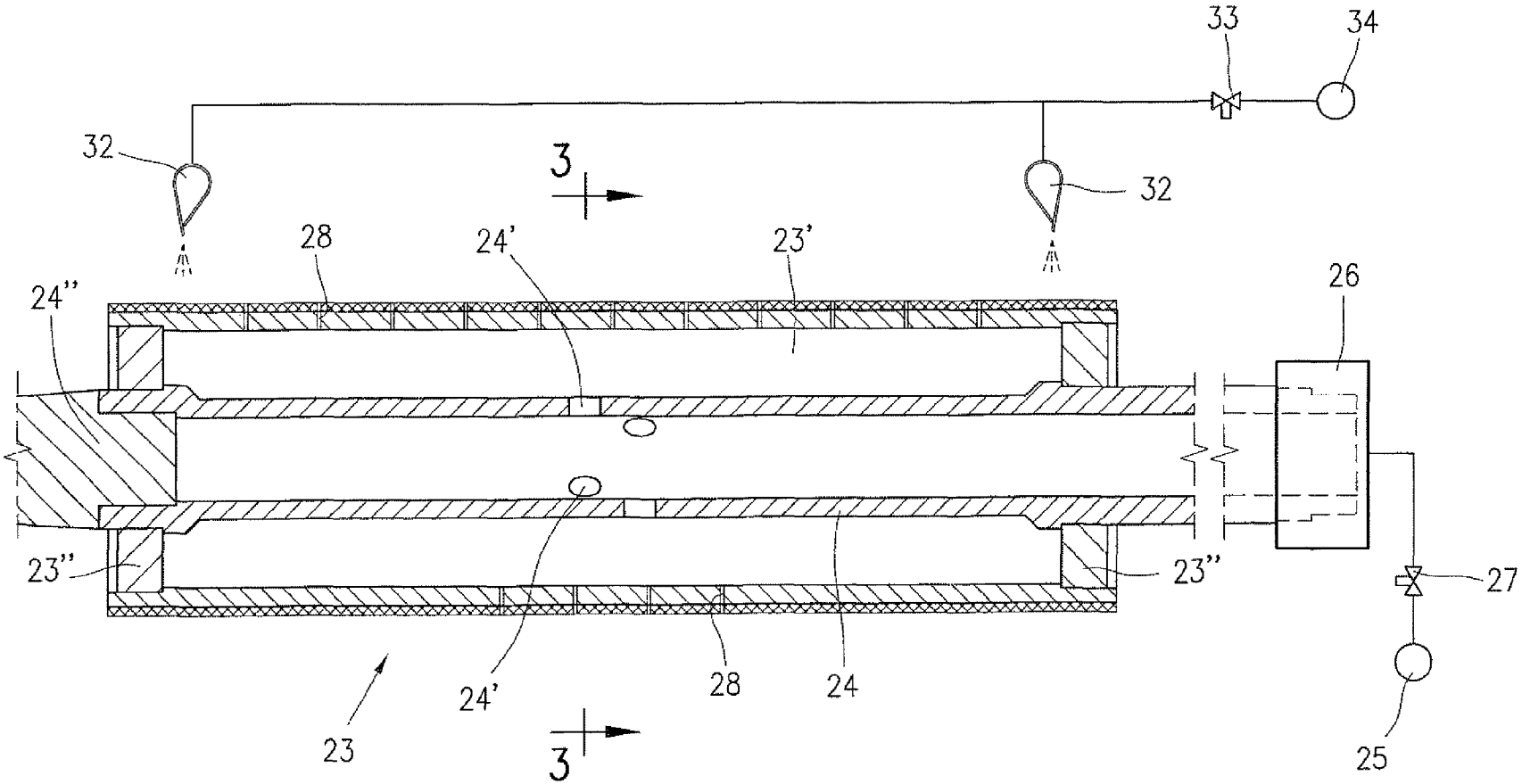
FIG. 2 shows a longitudinal cross-sectional view of a grooved drum, along the line 2-2 of FIG. 1.

As shown in FIG. 2, the drawing drum 23 comprises a hollow body defining an air suction chamber 23' closed at both ends by rings 23", being supported by a tubular shaft 24 which extends between the two rings 23"; the tubular shaft 24 is closed at one end 24", while is connected at its other end to an air suction source 25, for example a suction pump, by a rotary joint 26, and a control valve device 27 for controlling and adjusting the flow at the sucked air.

The tubular shaft 24 has a side wall provided with through holes 24' which put into fluid communication the suction chamber 23' of the hollow body of the drum 23 with the tubular shaft 24, thereby enabling the air into the outer grooves 31 of the drum 23 to be sucked into the suction chamber 23' through radial holes 28, and consequently the plastic film 10 to be sucked and folded into the grooves 31, in correspondence with a contact area of the film 10 with the drawing drum 23, as shown in FIG. 1, providing the same film 10 with suitable open-end cross corrugations 10A.

The quantity of air sucked through the holes 28 in the drum 23, can be changed and appropriately adjusted in any suitable manner, for example by means of the valve control device 27 for changing the air flow, or by adjusting the speed of the suction pump 25, or by any other suitable means.

Figure 3:
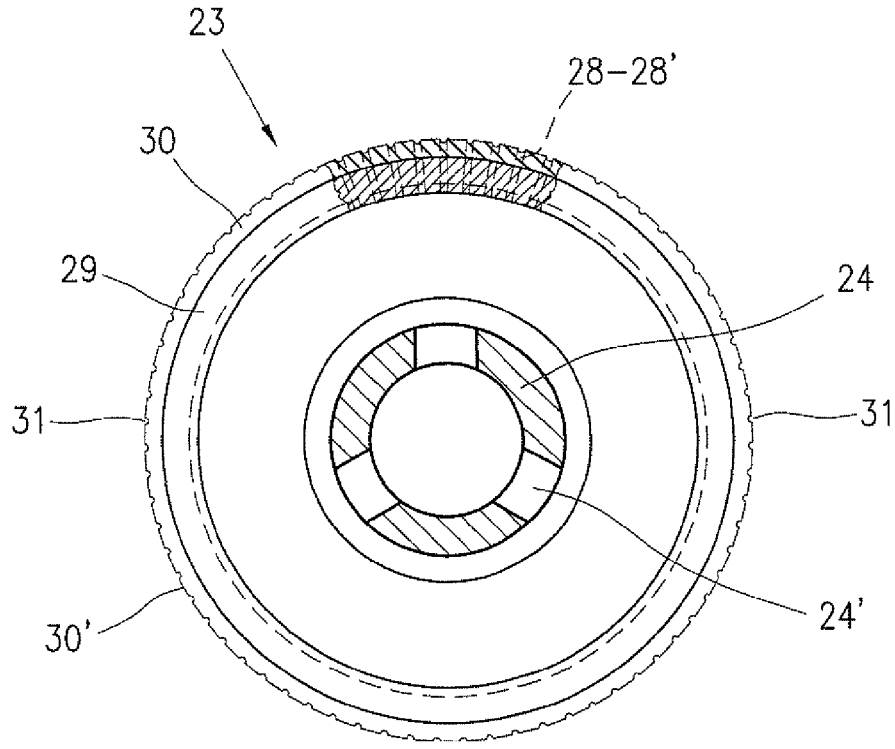
FIG. 3 shows a partially enlarged cross-sectional view of the grooved drum, along the line 3-3 of FIG. 2.
Figure 4:
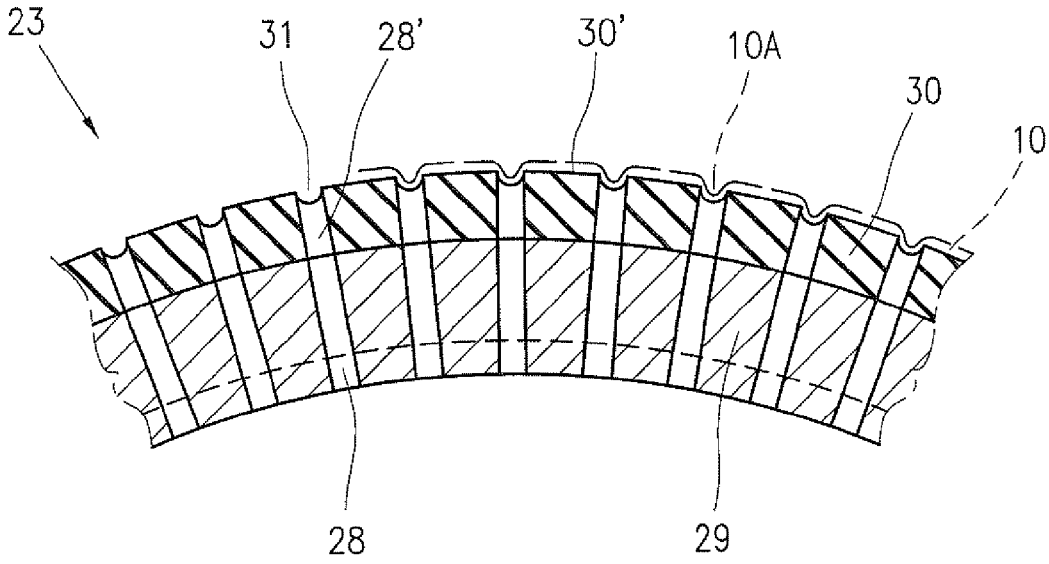
FIG. 4 shows an enlarged detail of FIG. 3.

As shown in FIG. 3 and in the enlarged detail of FIG. 4, the drawing drum 23 comprises a hollow cylinder body 29 provided with a coating or sheathing 30 of rubber or synthetic material, defining a peripheral contact surface 30, for the plastic film 10; in the case shown, the peripheral contact surface 30' of the sheathing 30, is provided with a plurality of longitudinal grooves 31 angularly spaced apart, in which air suction holes 28' axially aligned with corresponding air suction holes 28 in the peripheral wall of the hollow body 29 of the cylinder 23, open out.

The suction of the air in the contact area between the drawing drum 23 and the plastic film 10, tends to cause the plastic film to adhere and be sucked into the longitudinal grooves 31, thereby shaping the plastic film 10 with corrugations consisting in a plurality of crosswise pleats or folds 10A open at both ends which, during the progressive winding up of the film onto the roll 11, retain a small quantity of cushioning air to prevent the superimposed turns of the wound film to adhere each other, as well as a slight stress relieving and relaxation of the film, both during the winding onto the roll 11, and subsequently.

In fact, the formation of open-end crosswise pleats 31, makes it possible to compensate any elastic shrinkage of the plastic film, both during and after the winding of the roll 11; consequently it makes possible to obtain perfectly cylindrical rolls of regular shape, preventing their implosion and tightening of the internal turns which, in the case of coreless rolls or rolls with a soft core would cause a deformation of the central hole of the same roll which tends to prevent the insertion of a mandrel, for unwinding the film during the wrapping of a load.

Figure 5:
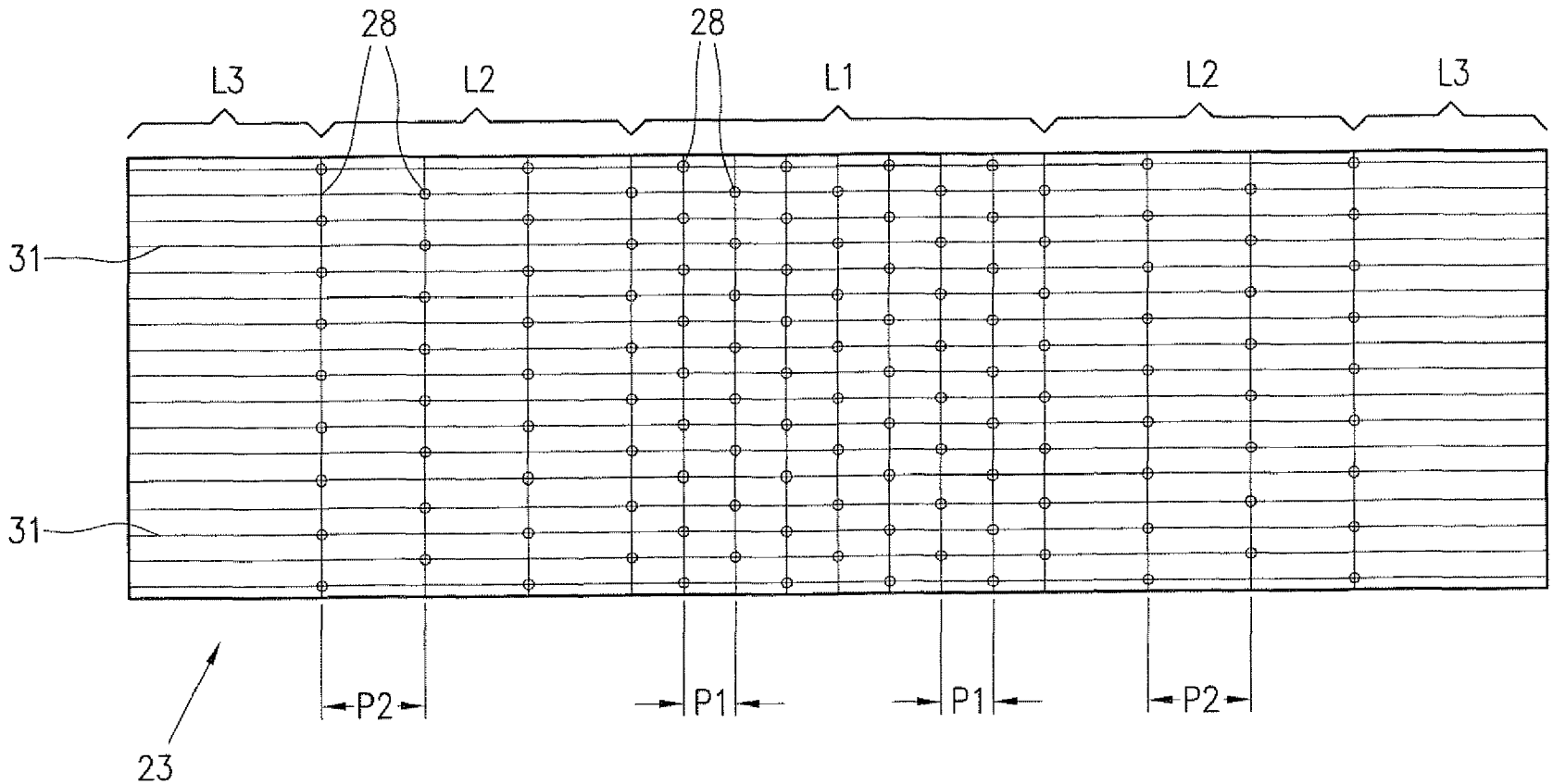
FIG. 5 shows a schematic representation of a possible disposition of the air intake holes, on the grooved drum.

The air suction holes 28, 281 can be anyway shaped and disposed along the longitudinal grooves 31 of the drum 23; one possible example is shown in FIG. 5 where the longitudinal lines represent the grooves 31, in which the transversal lines represent cross planes at right angle to the longitudinal axis of the drum and in which the radial air suction holes 28, 28' are circumferentially arranged.

Schematically, in the example of FIG. 5 the drum 23 has a first perforated central area L1 with the holes 28 disposed closer than the side areas, for example spaced apart by a first pitch P1, and second intermediate perforated areas L2 at both sides of the central area L1, having holes 18 spaced apart by a second pitch P2; a third area L3 devoid of holes 28 is provided at each end of the drum.

In particular, the holes 28 of the central area L1 have a pitch P1 of a pre-established value, while the holes 28 in the intermediate areas L2 have a pitch P2 equal to or greater than P1, for example double the length. This can be obtained by any disposition of the holes 18; for example, it can be achieved by maintaining a same axial space between the holes along the grooves 31, and staggering the holes of each groove with respect to the holes of the adjacent ones, or providing suction holes 28, differently spaced apart on all or some of the grooves 31.

Obviously, it is possible to contemplate any other disposition of the suction holes, of such kind as to maintain a greater number or concentration of holes 28 along a central section of the drum 23, and a smaller number of suction holes on the opposite side areas 42.

A greater concentration of suction holes 28 in the central area L1, has proved to be particularly advantageous in that it offers the possibility of causing, at the central portion of the drum 23, a greater suction force on the plastic film 10 and penetration into the grooves 31, allowing a certain air to flow from the ends towards the centre of the grooves themselves, thereby avoiding the formation of air pockets and, consequently, of irregular pleats or corrugations in the wound up film.

In the example of FIG. 5, the suction holes 18 are spaced apart by two pitches P1 and P2 along the areas L1 and L2, over sections of a pre-established length of the drum 23. However, without departing from the general teaching of the invention, the pitches, and the disposition of the holes 18 could also differ from those shown; for example, the pitch P of the holes along part or all of the grooves in the drum 23 could progressively increase from the centre towards the two ends of the drum; conversely a different conformation, for example a spiral disposition of the grooves could be contemplated in the drum.

The diameter of the holes 2S, the length, the depth and the width of the grooves 31, as well as the angular space between adjacent grooves can be of any size whatsoever, and must be chosen each time depending on specific requirements, and the characteristics of the plastic film to be wound.

Successful experiments have been carried out with perforated drums having a maximum diameter ranging from 150 to 180 mm, in which the holes 28 had a diameter ranging from 1.5 to 2.5 mm, an angular pitch between grooves ranging from 2° to 3°, and a pitch P between holes 28 along the same groove 31 ranging from 30 to 50 mm.

In the tested drums, the holes 28 all had a same diameter, however the use of holes of different diameters in the same drum could be also considered.

FIG. 2 of the drawings shows a further characteristic of the apparatus according to the invention, which contemplates the use of air jets in correspondence with the two external areas L3 devoid of suction holes of the drum, to give stability to the plastic film 10 during winding, maintaining the same film 10 in contact with the peripheral surface of the drum 23, to prevent side moving or telescoping and irregular winding of the film.

In fact, depending upon the working conditions of the apparatus, for example the speed and/or the thickness of the film, or for other causes, the plastic film 10 could have a certain instability or tendency to shift sideways, with the consequent winding of faulty rolls.

Consequently, according to a further feature of the invention, in correspondence with each end of the drawing drum 23, use of one or more nozzles 32 has been made for the ejection of air jets which urge and maintain the lateral edges of the plastic film 10 against the drum 23, preventing the same film from shifting sideways. Both nozzles 32 are connected, by a pressure adjusting valve 33, to a pressurised air source 34.

From what has been described and shown in the accompanying drawings it will be clear that a method and an apparatus are provided for winding up rolls of plastic film, wherein use is made of a grooved and perforated drum, connectable to a vacuum source, both in order to corrugate and to draw the plastic film, forming a plurality of cross folds or corrugations which extend between the opposite side edges of the film, as the latter is wound up around into a roll.

It is understood therefore that what has been described and shown with reference to the drawings, has been given purely by way of example in order to illustrate the general characteristics and those of preferential embodiments of the invention; consequently, other modifications or changes may be made, to the grooved and perforated drum, to the apparatus and to the film winding method, without departing from the claims.

What I claim is:

1. A method for winding up a roll of a stretchable plastic film wherein the plastic film is transversally corrugated comprising:

advancing the plastic film towards the roll being wound;

maintaining the film against a peripheral contact surface of a corrugating and drawing drum conformed with a plurality of angularly spaced apart and longitudinally extending outer grooves;

making the plastic film penetrate into the outer grooves of the drawing drum to provide open-end corrugations or crosswise pleats, while maintaining the plastic film in a relaxed condition substantially devoid of longitudinal stresses; and causing the formation of a plurality of crosswise pleats by sucking the plastic film into the outer grooves of the drawing drum.

2. The method according to claim 1 wherein the drawing drum is provided with an air suction chamber, and a plurality of air suction holes between the suction chamber and the outer grooves causing the plastic film to penetrate and fold into the grooves of the drawing drum by connecting the suction chamber to an air suction source to generate the air suction flux through said air suction holes.

3. The method according to claim 2, wherein the penetration of the plastic film into the grooves, is controlled by adjusting the air suction flux.

4. The method according to claim 3, further comprising causing the penetration of the plastic film by generating a differentiate air suction flux through the holes along the grooves of the drawing drum.

5. The method according to claim 3, wherein the penetration of the plastic film into the grooves is controlled by providing a differentiate air suction flux, decreasing the air suction from a central portion towards ends portions of the drawing drum.

6. The method according to claim 5, wherein a greater air suction flux is provided in a central area of the drum, and a lesser air suction flux at side areas, between said central area and the ends of the drawing drum.

7. The method according to claim 1, wherein the plastic film is made to adhere to the peripheral surface of the drawing drum, causing the plastic film to penetrate into the grooves by air jets in correspondence with a contact area devoid of air suction holes, at each end of the drawing drum.

* * * * *